United States Patent [19]

Riendeau et al.

[11] 4,048,608

[45] Sept. 13, 1977

[54] CIRCUIT BREAKER

[75] Inventors: William P. Riendeau, Leonardtown; Robert R. Blevins, Lexington Park; Joseph L. Abell, California, all of Md.

[73] Assignee: Aiken Industries, Inc., New York, N.Y.

[21] Appl. No.: 635,013

[22] Filed: Nov. 25, 1975

[51] Int. Cl.[2] ..... H01H 71/16

[52] U.S. Cl. ..... 337/74; 335/24

[58] Field of Search ..... 337/66, 64, 62, 70, 337/72, 73, 74, 75; 335/27, 38, 24

[56] References Cited

U.S. PATENT DOCUMENTS 3,287,523 11/1966 MacDonald et al. ..... 337/62

3,456,225 7/1969 Ellenberger ..... 337/66

*Primary Examiner*—Harold Broome

*Attorney, Agent, or Firm*—Sughrue, Rothwell, Mion, Zinn and Macpeak

[57] ABSTRACT

A double break, trip free circuit breaker is disclosed which is compensated for variations in ambient temperature. A biased rocker arm carries a contact bridging bar at one end and engages a heater/bimetal or electromagnetic back at the other. A segmented reset plunger allows for a manual trip capability in addition to circuit breaking even when the plunger is held in the reset position. High current handling capabilities result from the separating of the heater/bimetal circuit from the main current flow path.

10 Claims, 7 Drawing Figures

FIG. 1
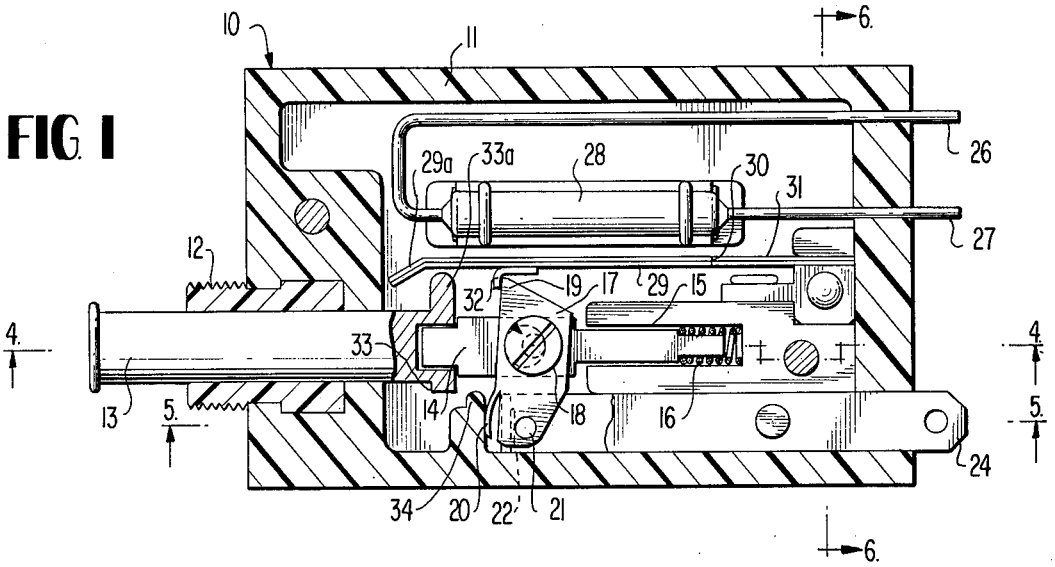
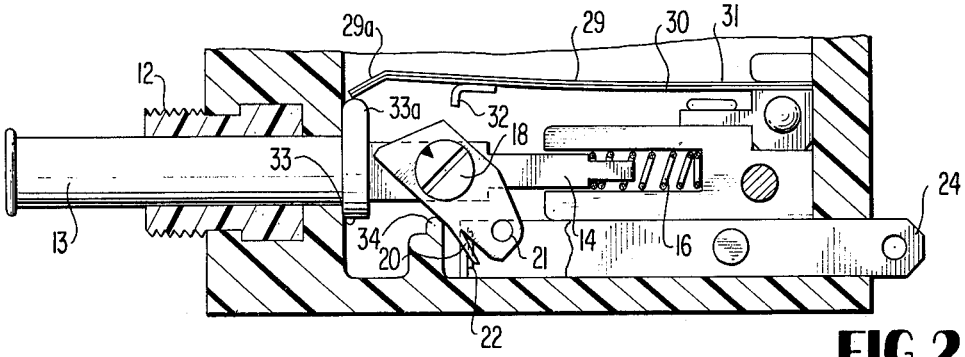
FIG. 2
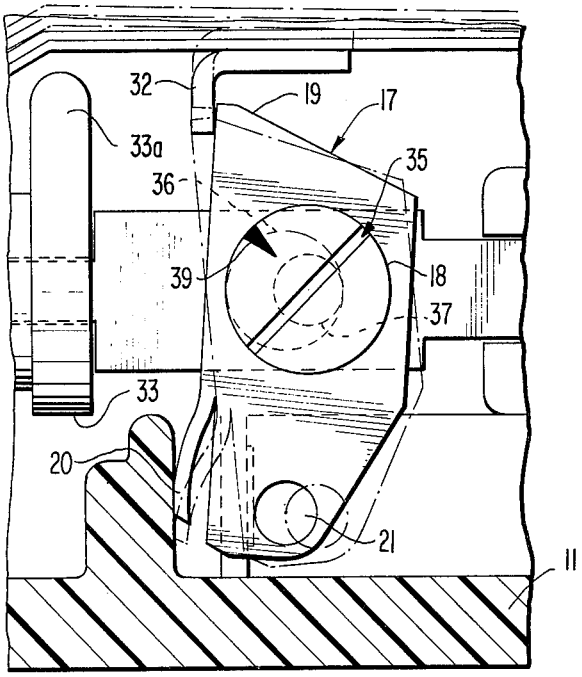
FIG. 3

CIRCUIT BREAKER

BACKGROUND OF THE INVENTION

This invention relates generally to electrical circuit breaker devices and more specifically to a double break trip-free circuit breaker which is ambient temperature compensated.

Various electrical and electro-mechanical circuits in the event of an electrical, mechanical or human failure can receive current surges which are potentially destructive to the individual electrical components. Therefore, circuit breakers are normally employed in such circuits so that if a high current condition occurs - because of a short or a current surge - the circuit will be interrupted. Normally, these circuit breakers are placed in the current path to various components which require their protection such that a high current load will cause the circuit breaker to interrupt the current flow to the device. In addition to their basic protection requirement, it is also advantageous for them to be small, lightweight, easily manufactured, etc. Examples of this type of circuit breaker are in U.S. Pat. Nos. 3,007,018 and 3,617,971.

There are a number of features which are particularly desirable in a circuit breaker which hitherto have not existed in any combination. A problem that has existed with past circuit breakers is the extreme amount of wear in the contacts, the point at which the electrical circuit is made and broken. These normally wear a little bit every time a circuit is made and every time it is broken there is a small amount of arcing resulting in the deposition of metal across the contacts. Over a period of time this makes the contacts unsuitable for making and breaking circuits. Either the circuit is not completely shorted or else it is never completely opened necessitating replacement of the entire circuit breaker. Additionally, circuit breakers of the single break type, that is having only one set of contacts, require a much larger contact area to have the same wear characteristics as the double break type contacts.

A double break contact circuit breaker has two sets of making and breaking points which operate simultaneously to provide two arc points and allow interruption of a higher current load than the single break contact having the same contact area. A problem in the double break contact type circuit breaker is the fact that during manufacture it is often difficult to perfectly align the two sets of breaker points and, of course, if both breaker points do not make and break at the same time the advantages of the double break circuit breaker are lost, and there is a possibility of the circuit breaker not making a complete circuit even when properly reset.

Many of the small, low capacity circuit breakers have a heater element and a bimetallic strip to provide the current sensing feature. However, the heat required to bend the bimetallic strip away from its latched position can vary considerably with variations in the ambient temperature. Therefore the temperature of the circuit breaker is at least partially determinative of the current load at which the circuit breaker will open the electric circuit that it is protecting. A further problem is that many circuit breakers have no manual trip capability such that the circuit breaker can be manually deactivated, for example when it is necessary to shut off a circuit completely for repairs or other maintenance. Additionally, many small circuit breakers, because of the fact that the heater coil is wrapped around the bimetallic strip or, in many cases, the resistance of the bimetallic strip itself may have very low current carrying capabilities and their use is precluded in higher current application situations. Furthermore, the low response speed between an overcurrent pulse and the opening of the circuit with heater/bimetal construction is very slow. It has been found that at least several seconds are required before the circuit is opened and where a human operator may have unintentionally shortcircuited certain equipment, it is desirable to protect him by opening the circuit after only a small amount of current has passed which requires an extremely fast response, on the order of milliseconds. Finally, many circuit breakers in the past have suffered from the failing that if the reset plunger is held in, the circuit breaker is prevented from breaking the circuit and will then result in an overcurrent situation in the component that would otherwise be protected.

It is therefore an object of the present invention to provide a circuit breaker which has self-cleaning and self-aligning contacts.

Another object of the instant invention is a circuit breaker that is compensated for changes in the ambient temperature of the circuit breaker such that the amount of current required to actuate the circuit breaker is not significantly affected.

Still another object of the present invention is to provide a manual trip capability such that the circuit breaker can be manually disengaged.

Another object of this invention is to provide a high shortcircuit capability such that large current loads can be carried by the circuit breaker without effecting its sensitivity to operational control currents.

A still further object of this invention is to provide a circuit breaker with an extremely high response speed to protect against immediate current overloads.

Another object is to provide a circuit breaker which cannot be manually overridden.

SUMMARY OF THE INVENTION

According to the present invention, the foregoing and other objects are attained by the use of a rocker arm mounted on a reset plunger with a contact bar on one end of the rocker arm and an engaging latch on the other end. The contact bar bridges the gap between two contacts connected to the major current terminals of the circuit breaker while the engaging latch engages in a bimetallic strip which is heated by a separate resistive heating element. The reset plunger is spring-loaded such that when the plunger is pressed in, the latch is engaged in the bimetallic strip and when released the contact bar is pressed against the two terminal contacts. Additionally, the rocker arm is self-biased such that even if the reset plunger is held in when the bimetallic strip is heated to disengage the latch, the rocker arm will still rotate allowing the contact bar to break the circuit between the two terminal leads. In accordance with one aspect of the invention, instead of a bimetallic element and a heater to provide latching and unlatching means, an electromagnet and solenoid combination are used to provide a fast response to unlatch the circuit breaker in the event of a current overload. A further aspect of the invention is a flanged extension on the latching mechanism which is moved by a manual tripping ear on the reset plunger such that when the reset plunger is manually pulled out, the latching mechanism is disengaged.

BRIEF DESCRIPTION OF THE DRAWINGS

FIG. 1 is a top view, partly in section, of the circuit breaker with the rocker arm in the latched position;

FIG. 2 is a top view, partly in section, of the rocker arm in the unlatched position;

FIG. 3 is a top view, partly in section, of the rocker arm showing the engaged and disengaged trip-free feature;

DETAILED DESCRIPTION

Figure 4:
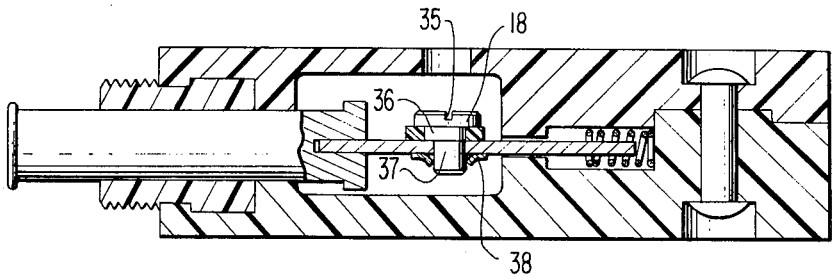
FIG. 4 is a section view along lines 4—4 of the circuit breaker of FIG. 1.
Figure 5:
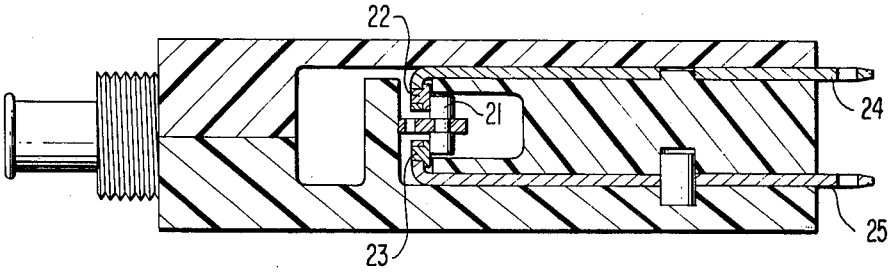
FIG. 5 is a section view along lines 5—5 of the circuit breaker in FIG. 1.
Figure 6:
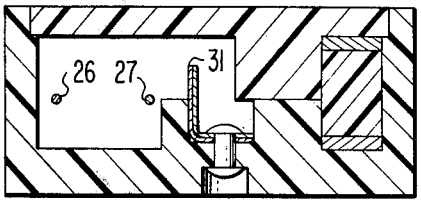
FIG. 6 is a section view along lines 6—6 of the circuit breaker in FIG. 1.

Reference is now made to the drawings wherein like reference numerals designate identical parts throughout the several views. As can be seen in FIGS. 1 through 6, the circuit breaker designated generally by 10 is comprised of casing 11 with mounting sleeve 12 fixably mounted therein. Reset plunger 13 is concentrically and slidably mounted inside sleeve 12 with extension 14 loosely mounted in one end thereof. Extension 14 extends through aperture 15 of the casing 11 and is biased in the outward position by spring 16. The rocker arm 17 is mounted on extension 14 by eccentric screw 18. On one end of rocker arm 17 is a latching nose 19 and on the other end a trip-free spring 20 to rotatably bias the rocker arm toward a counterclockwise position. Contact bar 21 is loosely and rotatably mounted in the end of rocker arm 17 and bridges the contact plates 22 and 23 which are electrically mounted in main terminals 24 and 25, as more completely seen in FIG. 5. Control terminals 26 and 27 are connected to heating element 28 which is in close proximity to bimetal 29. Bimetal 29 is welded at point 30 to bimetal 31 where the distortion direction of bimetal 29 is the opposite of bimetal 31 such that the position of the latch 32 remains constant over range of ambient temperatures.

FIG. 1 shows the rocker arm 17 in a latched position such that contact bar 21 bridges between contact plates 22 and 23 allowing full current to flow through main terminals 24 and 25. In the event of an excess current flow through heating element 28, bimetal 29 is thereby heated to the extent that the uneven expansion of the metals contained therein bends bimetal 29 away from and unlatches latching nose 19 of rocker arm 17 as shown in FIG. 2. Spring 16 then forces extension 14 and reset plunger 13 to their extended positions where flanges 33 and 33*a* contact the casing 11 thus limiting the travel of reset plunger 13. The cam action of lip 34 against rocker arm 17 causes the rocker arm to rotate removing the contact bar 21 from a conduction position with contact plates 22 and 23 thus cutting off current flow through main terminals 24 and 25. Relatching of the circuit breaker to the position of FIG. 1 is easily accomplished by pushing in on the reset plunger 13. The rocker arm 17 remains in the unlatched position as the plunger is depressed until the end with the contact bar 21 reaches the beginning of the aperture 15. As the reset plunger is further depressed, the rocker arm 17 is rotated clockwise until the latching nose 19 moves under latch 32. If the bimetal has cooled sufficiently, the latching nose will be engaged by the latch. The reset plunger is now released and the rocker arm continues to rotate clockwise as the eccentric screw 18 moves outward slightly and the latching nose 19 remains firmly latched. This movement continues under the urging of spring 16 until the contact bar 21 bridging the contacts 22 and 23 is reset.

A manual trip feature is provided by flange 33*a* and bimetal extension 29*a*. The reset plunger 13 is manually pulled in the outward direction and away from extension 14. Flange 33*a* gradually cams bimetal extension 29*a* in the upward direction. Latch 32 is pulled away from its engaged position with rocker arm 17 allowing extension 14 to be moved to the extended position by spring 16. As in the automatic mode, such movement of the extension causes the rocker arm to rotate and cease bridging contacts 22 and 23.

In FIG. 3 the aspects of the trip-free operation are shown. When the inner plunger 13 is not allowed to move to the extended position as indicated in FIG. 2 the contacts would normally remain bridged by contact bar 21. However it can be seen that when bimetal 29 releases the latching nose 19 the action of the trip-free spring 20 will cause rocker arm 17 to rotate about the eccentric 36 moving the contact bar 21 away from contact plates 22 and 23, thus cutting off current flow through main terminals 24 and 25. This then allows termination of current flow through the circuit breaker even if reset plunger 13 is manually held in the reset position. Additionally in FIG. 3, the details of eccentric screw 18 can be seen. Adjustment slot 35 allows the position of eccentric 36, upon which rocker arm 17 is mounted, to be varied as screw 18 is rotated about its mounting axis 37 which is frictionally connected through inner plunger 12 and retained by spring nut 38 (more clearly seen in FIG. 4). The position of the upper lobe of the eccentric 36 is indicated by notch 39. By inserting a screw driver into slot 35 the position of rocker arm 17 relative to the latch 32 on bimetal 29 can be varied thus adjusting the current level required to heat the bimetal enough to release nose 19, tripping circuit breaker 10. This adjustment feature is particularly useful in the manufacture of small circuit breakers where the significance of standard mechanical tolerances is large and could vary widely the current levels at which the circuit breaker would trip. Thus with this adjustment, the current level for tripping the circuit breaker can be adjusted with great precision upon its manufacture thus eliminating the need for greater than standard tolerance precision in manufacturing the circuit breaker.

Figure 7:
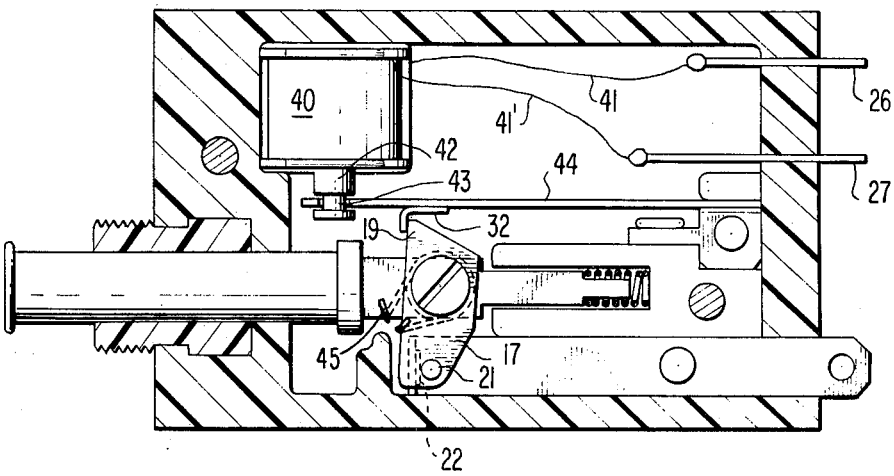
FIG. 7 is a top view, partly in section, of an alternate embodiment of the circuit breaker in FIG. 1.

A further embodiment of this invention is shown in FIG. 7 wherein heating element 28 and bimetal 29 have been replaced by an electromagnet 40 operatively connected to the control terminals 26 and 27 by leads 41 and 41'. Solenoid slug 42 is connected through slot 43 to spring strip 44 which includes latch 32. When the electromagnet 40 is energized by the control current through control leads 26 and 27 the slug 42 is withdrawn into the center of the electromagnet pulling up on spring strip 44 and latch 32 releasing latching nose 19 allowing the rocker arm to rotate and breaking the contact of the bar 21 across plates 22 and 23. One primary advantage of the electromagnet over the heating element/bimetal strip combination is that the response time of the electromagnet is on the order of milliseconds instead of several seconds or more. This allows for extremely fast response of the circuit breaker to a control current.

FIG. 7 also illustrates an embodiment of the invention without the manual trip feature since the plunger and extension are of a unified construction and the flange and bimetal extension have been eliminated. This feature is not limited to only the electromagnetically operated current breaker just as the electromagnetic circuit breaker is not limited to the unified construction.

The advantages of the instant invention over the prior art are numerous and quite significant. The double break contact allows for a greater current load with the same contact area. The self-cleaning self-aligning contacts are provided by the loose fit of the contact bar 21 such that it can rotate on its own axis and the fact that the axis is slightly rotatable in the rocker arm 17 allows a perfect contact between the contact bar 21 and contact plates 22 and 23. In the prior art the tolerances required to get such a contact with the fixed position contact bars were extremely close and were in many instances the critical defect of a particular circuit breaker. The self-aligning feature of the present invention's contacts as well as the self-cleaning ability to rotate on its own axis during the making and breaking of contacts distinguish this invention from the prior art. The ambient temperature compensation provided by the reverse welding bimetal strips 29 and 31 at weld 30 allow a range of temperatures between −20° F. and +150° F. without any adjustment to the latching mechanism. The segregation of heating element 28 and bimetal 29 allows a heavier construction in the element. Because the current does not go through the bimetal, the heater can be of a more rugged nature and the main terminals can handle a relatively heavy current for a small circuit breaker. And in the event that a high speed response capability is desired, the electromagnetic unlatching mechanism can be substituted for the heating element/bimetal latching system which will allow high speed response to a relatively low control signal.

Numerous variations on the preferred embodiments shown in the figures will be readily apparent to one skilled in the art of circuit breaker design. For example, the main terminals could be interconnected to the control terminals allowing either two, three or four terminal connection to the circuit breaker. Furthermore, the trip-free spring 20 could be a torsional spring 45 connected around eccentric screw 18 as shown in FIG. 7 rather than integral with said rocker arm 17. Spring strip 44 could be constructed of a number of springy plastics or metals such as phospor-bronze, stainless steel, etc. If spring strip 44 was replaced by a bimetal strip the magnetic circuit breaker shown in FIG. 8 would then be sensitive to temperature as well as control signals through the magnetic coil. Therefore the circuit breaker would trip in response to a particular ambient temperature as well as the control current.

Although the invention has been described relative to specific embodiments thereof, it is not so limited and many modifications and variations thereof will be readily apparent to those skilled in the art in the light of the above teachings. It is therefore understood that within the scope of the appended claims the invention may be practiced otherwise than as specifically described.

What is claimed is:

1. A double break circuit breaker having ambient compensation and automatic overload current protection comprising:

a hollow casing;

a reset means having a longitudinal axis disposed in said casing for linear movement between an inward and an outward position;

biasing means in said casing for urging said reset means in said outward direction;

a rocker arm pivotally supported on said reset means for rotation about an axis perpendicular to the direction of movement of said reset means;

contact means, disposed in said casing, for providing an electrical path through said circuit breaker when bridged;

a contact bridging bar, mounted on one end of said rocker arm, for bridging said contact means and providing an electrical path through said circuit breaker, said contact bridging bar having a longitudinal axis parallel with the axis of rotation of said rocker arm and being loosely mounted in said rocker arm and freely rotatable about said longitudinal axis;

a trip latch disposed in said casing and engageable with the other end of said rocker arm; and means for causing said trip latch to release said rocker arm so as to move said contact bridging bar away from said contact means in response to an electric current through the circuit breaker exceeding a predetermined value.

2. The apparatus of claim 1 wherein said reset means is comprised of a reset plunger and an extension, said extension is removably engageable with said reset plunger along said axis and is disposed between said plunger and said biasing means with said rocker arm mounted thereon such that when said plunger is displaced to the outward position manually said extension remains in an inward position as long as said rocker arm maintains said contact bar in a bridged condition and when said plunger is displaced to the inward position said extension is also displaced inward against said biasing means until said rocker arm is engageable with said trip latch.

3. The apparatus of claim 1 including trip free biasing means for rotatably biasing said rocker arm wherein said contact bar bridges said contact means only when said trip latch is engaged with said other end of said rocker arm and said reset plunger is released.

4. The apparatus of claim 1 wherein said trip latch is comprised of a bimetal strip which engages said other end of said rocker arm; and said means for causing said trip latch to release said rocker arm is comprised of a heating element and suitable electrical connections to provide current flow thereto such that said heating element heats said bimetal strip causing said strip to bend away from and release said rocker arm.

5. The apparatus of claim 1 wherein said means for causing said trip latch to release said rocker arm is comprised of:

a hollow electromagnetic coil;

a steel plunger slidably mounted in said hollow coil, said plunger physically connected to said trip latch such that when said electromagnet is energized said steel plunger is pulled into the hollow coil releasing said trip latch from an engaged position with said rocker arm allowing said circuit breaker to terminate current flow therethrough.

6. The apparatus of claim 4 wherein said ambient compensation is comprised of a reverse welded bimetal strip with only one end exposed to said heating element such that variations in ambient temperature do not effect the extent that said trip latch is engaged with said other end of said rocker arm.

7. The apparatus of claim 1 wherein said circuit breaker has manual trip means for manually actuating said trip latch comprising:

an extension of said trip latch;

an angled flange mounted on said reset plunger such that when said plunger is moved toward said outward position, said flange contacts said extension of said trip latch causing said trip latch to release said other end of said rocker.

8. The apparatus of claim 3, wherein said trip free biasing means is a spring integrally formed with said rocker arm and protruding therefrom.

9. The apparatus of claim 3 wherein said trip free biasing means is a torsional spring about said rocker arm pivot axis.

10. The apparatus of claim 1 wherein said rocker arm is pivotally supported on said reset means by means of an eccentric, the rotation of which permits adjustment of the release characteristic of the circuit breaker.

* * * * *